US010883219B2

(12) United States Patent
Billa

(10) Patent No.: US 10,883,219 B2
(45) Date of Patent: Jan. 5, 2021

(54) WASHING MACHINE OVERFLOW PREVENTION DEVICE

(71) Applicant: Matthew Billa, Riverview, FL (US)

(72) Inventor: Matthew Billa, Riverview, FL (US)

( * ) Notice: Subject to any disclaimer, the term of this patent is extended or adjusted under 35 U.S.C. 154(b) by 265 days.

(21) Appl. No.: 16/108,297

(22) Filed: Aug. 22, 2018

(65) Prior Publication Data

US 2020/0063325 A1 Feb. 27, 2020

(51) Int. Cl.
*D06F 39/08* (2006.01)

(52) U.S. Cl.
CPC ..... *D06F 39/082* (2013.01); *D06F 39/087* (2013.01)

(58) Field of Classification Search
CPC ..... D06F 39/08; D06F 39/081; D06F 39/082; D06F 39/087; A47L 15/421; H01H 35/18; G01F 23/74; E03B 7/071
USPC ..... 68/12.21
See application file for complete search history.

(56) References Cited

U.S. PATENT DOCUMENTS 3,185,789 A 5/1965 Gunter
4,069,837 A 1/1978 Jirasek
5,028,910 A 7/1991 Meacham
5,125,247 A 6/1992 Mills
5,493,877 A 2/1996 Wickremasing
5,967,175 A 10/1999 Bouzaglou
8,910,654 B2 12/2014 Dawes
D798,910 S 10/2017 McCrossen
2010/0175762 A1* 7/2010 Anacrelico ..... D06F 39/081 137/387
2016/0002842 A1* 1/2016 Dawes ..... D06F 39/081 137/398

FOREIGN PATENT DOCUMENTS

WO WO2017137870 8/2017

* cited by examiner

*Primary Examiner* — Tinsae B Ayalew

(57) ABSTRACT

A washing machine overflow prevention device for preventing flooding includes a plug-port assembly that comprises a plug, a port, and a breaker. The plug is configured to insert into an outlet that is coupled to an electrical circuit of a building. The port is configured to insert a power cord plug of a washing machine to power the washing machine, and the breaker is positioned to operationally couple the plug to the port. A switching sensor is coupled to and positioned in a standpipe. The switching sensor is operationally coupled to the plug and the breaker. The switching sensor is configured to detect a water level in the standpipe and to selectively actuate the breaker to decouple the port from the plug in event of a high-water level in the standpipe to prevent flooding of an area proximate to the washing machine.

10 Claims, 5 Drawing Sheets

WASHING MACHINE OVERFLOW PREVENTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to overflow prevention devices and more particularly pertains to a new overflow prevention device for preventing flooding.

BRIEF SUMMARY OF THE INVENTION

An embodiment of the disclosure meets the needs presented above by generally comprising a plug-port assembly that comprises a plug, a port, and a breaker. The plug is configured to insert into an outlet that is coupled to an electrical circuit of a building. The port is configured to insert a power cord plug of a washing machine to power the washing machine, and the breaker is positioned to operationally couple the plug to the port. A switching sensor is coupled to and positioned in a standpipe. The switching sensor is operationally coupled to the plug and the breaker. The switching sensor is configured to detect a water level in the standpipe and to selectively actuate the breaker to decouple the port from the plug in event of a high-water level in the standpipe to prevent flooding of an area proximate to the washing machine.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
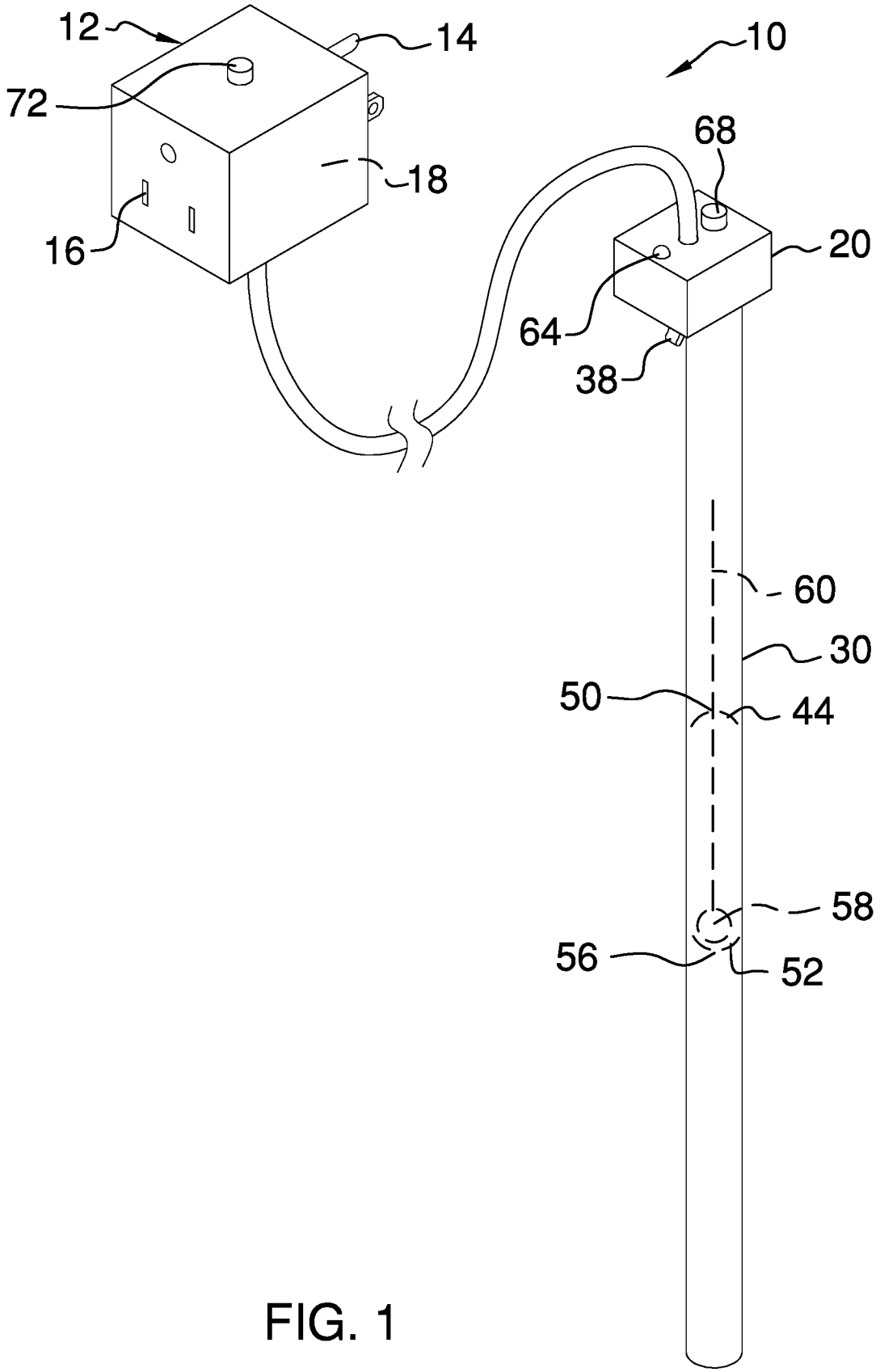
FIG. 1 is an isometric perspective view of a washing machine overflow prevention device according to an embodiment of the disclosure.

With reference now to the drawings, and in particular to FIGS. 1 through 5 thereof, a new overflow prevention device embodying the principles and concepts of an embodiment of the disclosure and generally designated by the reference numeral 10 will be described.

Figure 2:
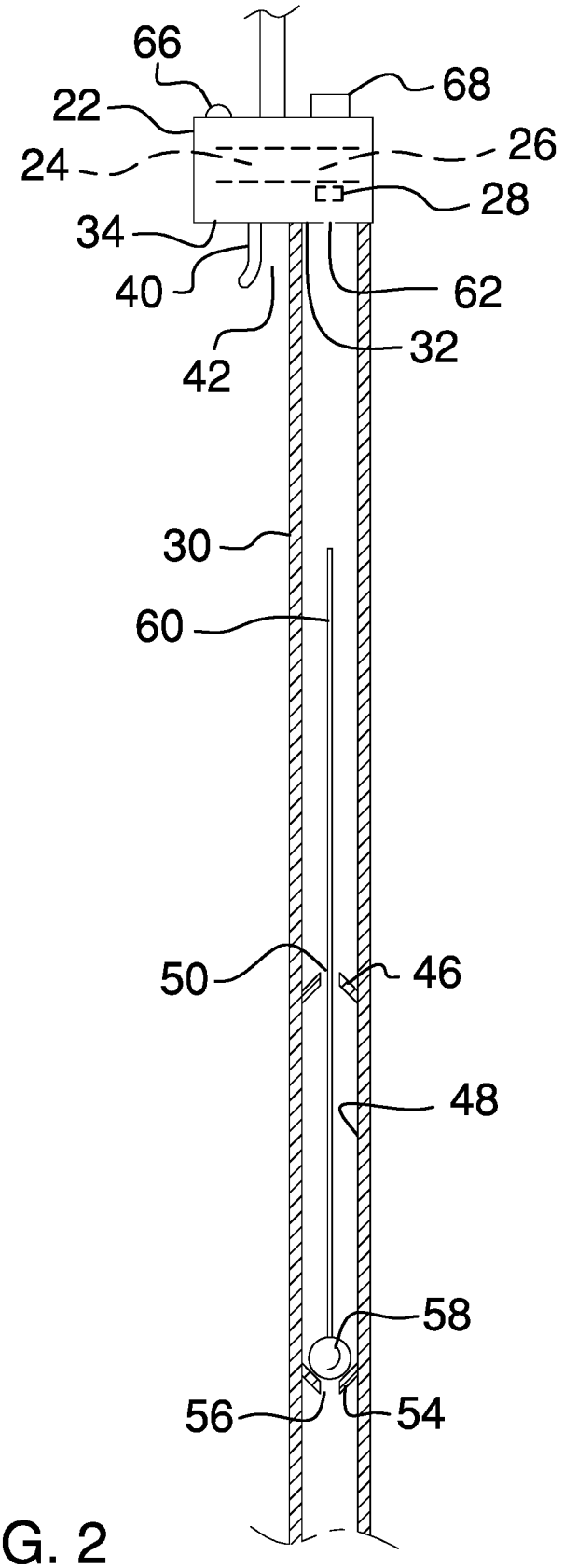
FIG. 2 is a cross-sectional view of an embodiment of the disclosure.
Figure 3:
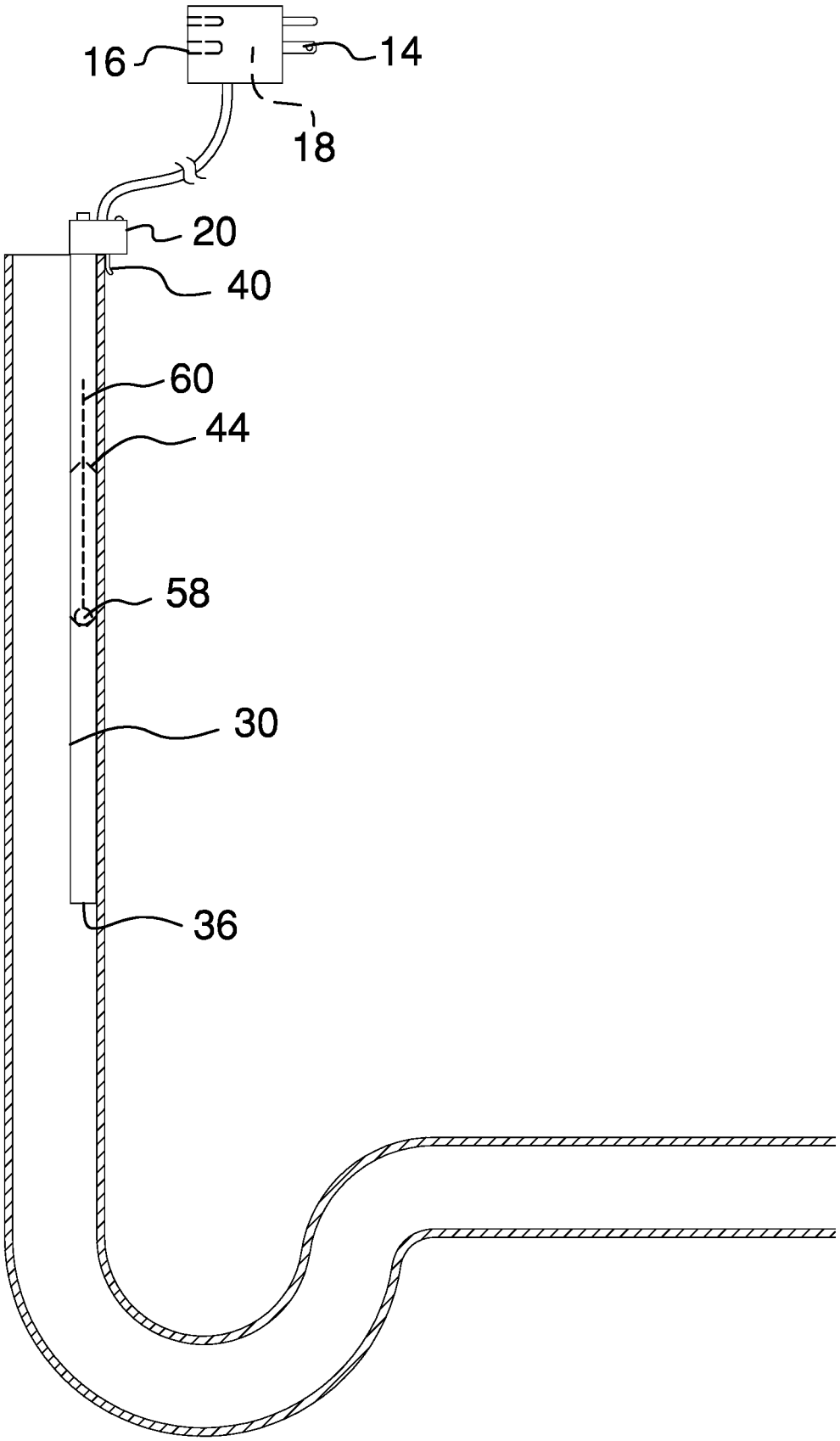
FIG. 3 is a side view of an embodiment of the disclosure.
Figure 4:
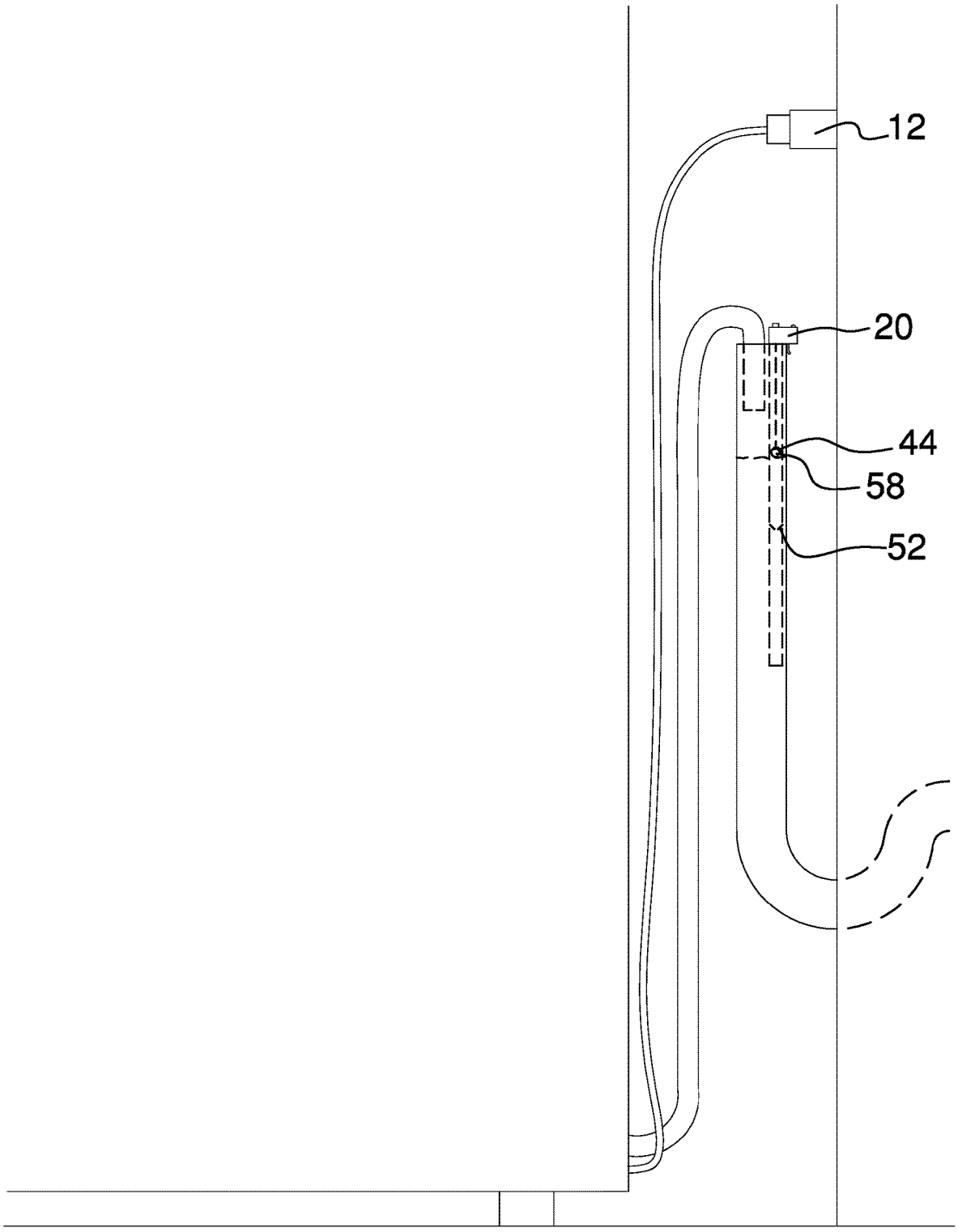
FIG. 4 is an in-use view of an embodiment of the disclosure.

As best illustrated in FIGS. 1 through 5, the washing machine overflow prevention device 10 generally comprises a plug-port assembly 12 that comprises a plug 14, a port 16, and a breaker 18. The plug 14 is configured to insert into an outlet that is coupled to an electrical circuit of a building, as shown in FIG. 4. The port 16 is configured to insert a power cord plug of a washing machine to power the washing machine, as shown in FIG. 4. The breaker 18 is positioned to operationally couple the plug 14 to the port 16.

A switching sensor 20 is coupled to and positioned in a standpipe, as shown in FIG. 4. A drain hose from the washing machine would be inserted into the standpipe. The switching sensor 20 is operationally coupled to the plug 14 so that the switching sensor 20 receives power from the electrical circuit. The switching sensor 20 also is operationally coupled to the breaker 18. The switching sensor 20 is configured to detect a water level in the standpipe and to selectively actuate the breaker 18 to decouple the port 16 from the plug 14 in event of a high-water level in the standpipe to prevent flooding of an area proximate to the washing machine.

The switching sensor 20 comprises a housing 22 that defines an interior space 24. A microprocessor 26 and a trip switch 28 are coupled to the housing 22 and are positioned in the interior space 24, as shown in FIG. 2. The trip switch 28 is operationally coupled to the microprocessor 26. A tube 30 is coupled by an upper end 32 to the housing 22. The tube 30 extends substantially perpendicularly from a lower face 34 of the housing 22. The tube 30 has a lower end 36 that is open.

A coupler 38 that is coupled to the housing 22 is configured to couple the housing 22 to an upper rim of the standpipe. The coupler 38 comprises a clip 40 that is coupled to and extends from the lower face 34 of the housing 22 so that the clip 40 and the tube 30 define a slot 42. The slot 42 is configured to insert a wall of the standpipe to couple the housing 22 to the upper rim of the standpipe, as shown in FIG. 3.

An upper catch 44 is coupled to and positioned in the tube 30, as shown in FIG. 2. The upper catch 44 comprises an upper disc 46 that is coupled to the tube 30 and extends around an internal perimeter 48 of the tube 30. The upper disc 46 is concavely arcuate so that the upper disc 46 extends toward the housing 22. A first hole 50 is centrally positioned through the upper disc 46.

A lower catch 52 is coupled to and positioned in the tube 30 between the upper catch 44 and the lower end 36 of the tube 30, as shown in FIG. 2. The lower catch 52 comprises a lower disc 54 that is coupled to the tube 30 and extends around the internal perimeter 48 of the tube 30. The lower disc 54 is concavely arcuate so that the lower disc 54 extends toward lower end 36 of the tube 30. A second hole 56 is centrally positioned through the lower disc 54. The second hole 56 is configured to allow passage of water through the lower disc 54, as would occur when water rises in the standpipe.

A sphere 58 is positioned in the tube 30 between the upper catch 44 and the lower catch 52. The sphere 58 is configured to float at a level of water in the standpipe. The sphere 58 is positioned to substantially seal the first hole 50 so that water does not pass through the first hole 50.

A rod 60 is coupled to the sphere 58 and extends through the upper catch 44. The rod 60 is positioned through the first hole 50. The rod 60 is positioned to insert through an orifice 62 that is positioned in the lower face 34 of the housing 22 to actuate the trip switch 28 when the sphere 58 rises to the upper catch 44. The microprocessor 26 is positioned to actuate the breaker 18 to decouple the port 16 from the plug 14 in event of a high-water level in the standpipe to prevent flooding of an area proximate to the washing machine.

A bulb 64, which comprises a red light emitting diode 66, is coupled to the housing 22 and is operationally coupled to the microprocessor 26. The microprocessor 26 is positioned to actuate the bulb 64 upon actuation of the trip switch 28 by the rod 60 to alert a user to a high-water level event.

A reset button 68 is coupled to and extends from the housing 22, as shown in FIG. 1. The reset button 68, which is depressible, is operationally coupled to the microprocessor 26. The reset button 68 is configured to be depressed to reset the trip switch 28 after the high-water level event.

Figure 5:
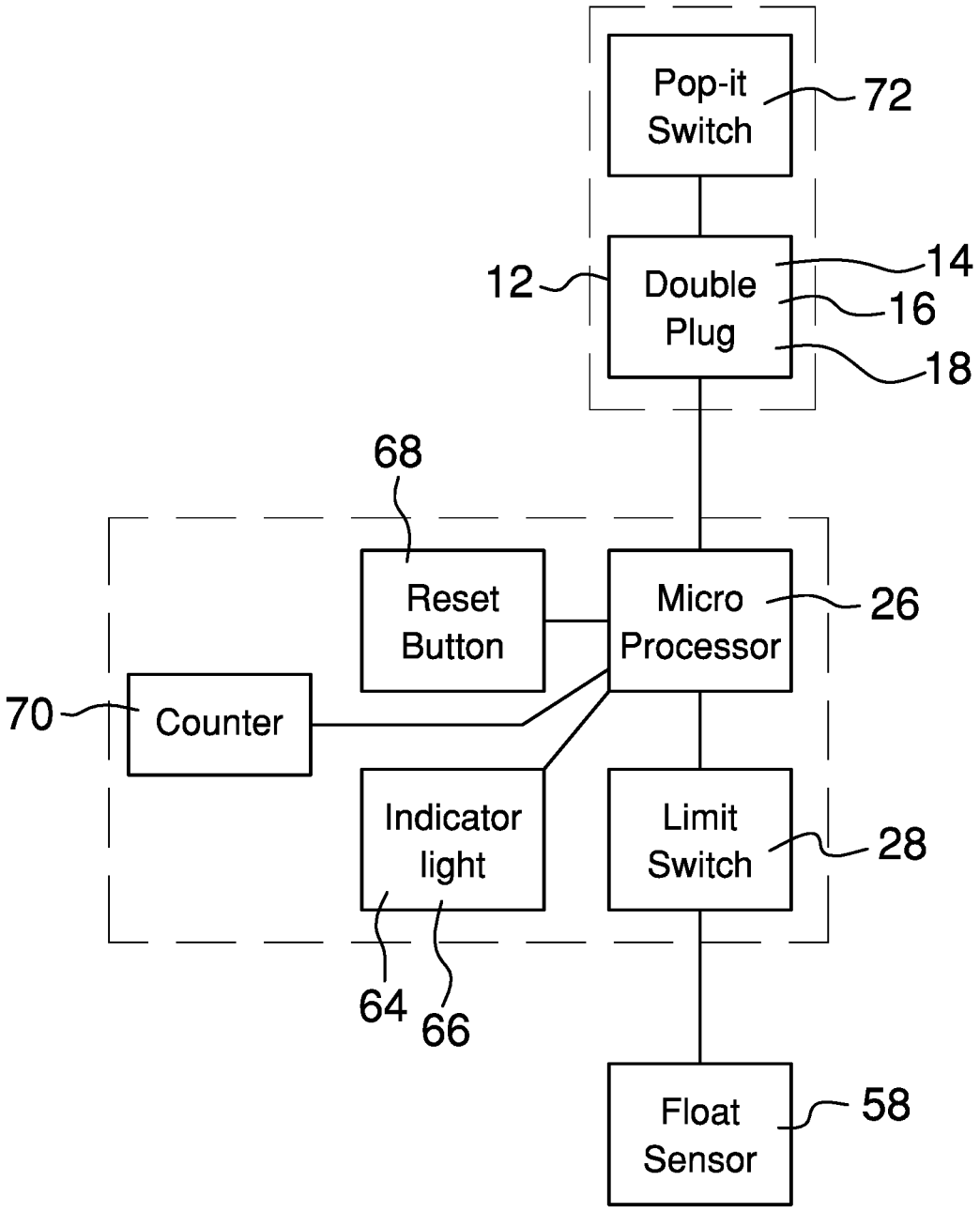
FIG. 5 is a block diagram of an embodiment of the disclosure.

In one embodiment, as shown in FIG. 5, a counter 70 is coupled to the housing 22 and is positioned in the interior space 24. The counter 70 is operationally coupled to the microprocessor 26 and is positioned to enumerate a number of high-water level events. The counter 70 would serve to validate the occurrence of a high-water level event.

A knob 72, which is depressible, is coupled to the plug-port assembly 12, as shown in FIG. 1, and is operationally coupled to the breaker 18. The knob 72 is configured to be depressed to reset the breaker 18 after the high-water level event to couple the port 16 to the plug 14.

In use, the tube 30 is inserted into the standpipe, positioning the slot 42 to insert the wall of the standpipe to couple the housing 22 to the upper rim of the standpipe. The plug 14 is plugged into the wall, and the power cord plug of the washing machine is plugged into the port 16. The user then operates the washing machine as required. Should water rise in the standpipe, as would occur in event of a significant or total blockage of the standpipe or drain, the sphere 58 would rise to the upper catch 44, urging the rod 60 to actuate the trip switch 28. The microprocessor 26 then would actuate the breaker 18, preventing flooding of the area proximate to the washing machine. The microprocessor 26 also would actuate the bulb 64 to indicate to the user that a high-water level event has occurred. After correcting the blockage, the user would depress the reset button 68 and the knob 72 to resume operation of the washing machine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A washing machine overflow prevention device comprising:

a plug-port assembly comprising a plug, a port, and a breaker wherein the plug of the plug-port assembly is configured for inserting into an outlet coupled to an electrical circuit of a building, the port is configured for inserting a power cord plug of a washing machine for powering the washing machine, and the breaker is positioned for operationally coupling the plug of the plug-port assembly to the port; and a switching sensor coupled to and positioned in a standpipe, the switching sensor being operationally coupled to the plug of the plug-port assembly such that the switching sensor receives power from the electrical circuit, the switching sensor being operationally coupled to the breaker wherein the switching sensor is configured for detecting a water level in the standpipe and for selectively actuating the breaker for decoupling the port from the plug of the plug-port assembly in event of a high-water level in the standpipe for preventing flooding of an area proximate to the washing machine, the switching sensor comprising a housing defining an interior space, a microprocessor coupled to the housing and positioned in the interior space, a trip switch coupled to the housing and positioned in the interior space, the trip switch being operationally coupled to the microprocessor, a tube coupled by an upper end to the housing, the tube extending perpendicularly from a lower face of the housing, the tube having a lower end, the lower end being open, a coupler coupled to the housing wherein the coupler is configured for coupling the housing to an upper rim of the standpipe, an upper catch coupled to and positioned in the tube, a lower catch coupled to and positioned in the tube between the upper catch and the lower end of the tube, a sphere positioned in the tube between the upper catch and the lower catch wherein the sphere is configured for floating at a level of water in the standpipe, and a rod coupled to the sphere and extending through the upper catch wherein the rod is positioned for inserting through an orifice positioned in the lower face of the housing for actuating the trip switch when the sphere rises to the upper catch positioning the microprocessor for actuating the breaker for decoupling the port from the plug in event of a high-water level in the standpipe for preventing flooding of an area proximate to the washing machine.

2. The device of claim 1, further including the coupler comprising a clip coupled to and extending from the lower face of the housing such that the clip and the tube define a slot wherein the slot is configured for inserting a wall of the standpipe for coupling the housing to the upper rim of the standpipe.

3. The device of claim 1, further comprising:

the upper catch comprising:

an upper disc coupled to the tube and extending around an internal perimeter of the tube, and a first hole centrally positioned through the upper disc, the rod being positioned through the first hole; and the lower catch comprising:

a lower disc coupled to the tube and extending around the internal perimeter of the tube, and a second hole centrally positioned through the lower disc wherein the second hole is configured for passing of water through the lower disc.

4. The device of claim 3, further comprising:

the upper disc being concavely arcuate such that the upper disc extends toward the housing wherein the sphere is positioned for substantially sealing the first hole such that water does not pass through the first hole; and the lower disc being concavely arcuate such that the lower disc extends toward lower end of the tube.

5. The device of claim 1, further including a bulb coupled to the housing, the bulb being operationally coupled to the microprocessor wherein the microprocessor is positioned for actuating the bulb upon actuation of the trip switch by the rod for alerting a user to a high-water level event.

6. The device of claim 5, further including the bulb comprising a red light emitting diode.

7. The device of claim 1, further including a reset button coupled to and extending from the housing, the reset button being operationally coupled to the microprocessor, the reset button being depressible wherein the reset button is configured for depressing for resetting the trip switch after the high-water level event.

8. The device of claim 1, further including a counter coupled to the housing and positioned in the interior space, the counter being operationally coupled to the microprocessor wherein the counter is positioned for enumerating a number of high-water level events.

9. The device of claim 1, further including a knob coupled to the plug-port assembly, the knob being depressible, the knob being operationally coupled to the breaker wherein the knob is configured for depressing for resetting the breaker after the high-water level event for coupling the port to the plug.

10. A washing machine overflow prevention device comprising:

a plug-port assembly comprising a plug, a port, and a breaker wherein the plug of the plug-port assembly is configured for inserting into an outlet coupled to an electrical circuit of a building, the port is configured for inserting a power cord plug of a washing machine for powering the washing machine, and the breaker is positioned for operationally coupling the plug of the plug-port assembly to the port;

a switching sensor coupled to and positioned in a standpipe, the switching sensor being operationally coupled to the plug of the plug-port assembly such that the switching sensor receives power from the electrical circuit, the switching sensor being operationally coupled to the breaker wherein the switching sensor is configured for detecting a water level in the standpipe and for selectively actuating the breaker for decoupling the port from the plug of the plug-port assembly in event of a high-water level in the standpipe for preventing flooding of an area proximate to the washing machine, the switching sensor comprising:

a housing defining an interior space, a microprocessor coupled to the housing and positioned in the interior space, a trip switch coupled to the housing and positioned in the interior space, the trip switch being operationally coupled to the microprocessor, a tube coupled by an upper end to the housing, the tube extending perpendicularly from a lower face of the housing, the tube having a lower end, the lower end being open, a coupler coupled to the housing wherein the coupler is configured for coupling the housing to an upper rim of the standpipe, the coupler comprising a clip coupled to and extending from the lower face of the housing such that the clip and the tube define a slot wherein the slot is configured for inserting a wall of the standpipe for coupling the housing to the upper rim of the standpipe, an upper catch coupled to and positioned in the tube, the upper catch comprising:

an upper disc coupled to the tube and extending around an internal perimeter of the tube, the upper disc being concavely arcuate such that the upper disc extends toward the housing, and a first hole centrally positioned through the upper disc, a lower catch coupled to and positioned in the tube between the upper catch and the lower end of the tube, the lower catch comprising:

a lower disc coupled to the tube and extending around the internal perimeter of the tube, the lower disc being concavely arcuate such that the lower disc extends toward lower end of the tube, and a second hole centrally positioned through the lower disc wherein the second hole is configured for passing of water through the lower disc, a sphere positioned in the tube between the upper catch and the lower catch wherein the sphere is configured for floating at a level of water in the standpipe, wherein the sphere is positioned for substantially sealing the first hole such that water does not pass through the first hole, a rod coupled to the sphere and extending through the upper catch wherein the rod is positioned for inserting through an orifice positioned in the lower face of the housing for actuating the trip switch when the sphere rises to the upper catch positioning the microprocessor for actuating the breaker for decoupling the port from the plug in event of a high-water level in the standpipe for preventing flooding of an area proximate to the washing machine, the rod being positioned through the first hole, a bulb coupled to the housing, the bulb being operationally coupled to the microprocessor wherein the microprocessor is positioned for actuating the bulb upon actuation of the trip switch by the rod for alerting a user to a high-water level event, the bulb comprising a red light emitting diode, a reset button coupled to and extending from the housing, the reset button being operationally coupled to the microprocessor, the reset button being depressible wherein the reset button is configured for depressing for resetting the trip switch after the high-water level event, and a counter coupled to the housing and positioned in the interior space, the counter being operationally coupled to the microprocessor wherein the counter is positioned for enumerating a number of high-water level events; and a knob coupled to the plug-port assembly, the knob being depressible, the knob being operationally coupled to the breaker wherein the knob is configured for depressing for resetting the breaker after the high-water level event for coupling the port to the plug.

* * * * *